United States Patent [19]

Mathieu

[11] 4,398,488

[45] Aug. 16, 1983

[54] REMOVABLE CANOE-CARRIED COOLER

[76] Inventor: Kenneth G. Mathieu, 33980 Oakdale, Livonia, Mich. 48154

[21] Appl. No.: 304,120

[22] Filed: Sep. 21, 1981

[51] Int. Cl.[3] ..... B63B 17/00

[52] U.S. Cl. ..... 114/343; 114/347; 114/363; 220/412

[58] Field of Search ..... 220/412; 211/133; 308/3 R; 114/343, 347, 363

[56] References Cited

U.S. PATENT DOCUMENTS

| | | | |
|---|---|---|---|
| 828,072 | 8/1906 | Tenneson | 114/363 X |
| 3,498,685 | 3/1970 | Poplinski | 308/3 R |
| 3,958,289 | 5/1976 | Carlson | 114/363 X |
| 4,146,279 | 3/1979 | Stahel | 114/363 X |

OTHER PUBLICATIONS

"Motor Boats", vol. 48, issue 4, p. 49, Apr. 1951.

*Primary Examiner*—Sherman D. Basinger
*Attorney, Agent, or Firm*—William L. Fisher

[57] ABSTRACT

A removeable canoe-carried cooler for a canoe having an interior perimeter top rim, the canoe-carried cooler having an insulated container portion, an insulated hinged lid therefor, and a lock for the lid, the canoe-carried cooler constructed to be fitted into a canoe and to be removed therefrom at will, the construction of the canoe-carried cooler being such that when it is inserted in the canoe and pulled toward an end thereof it wedges and locks itself in place therein, the canoe-carried cooler having tapered side walls which are wider at one end than at the other so that as the canoe-carried cooler is pulled toward an end of the canoe widthwise wedging thereof occurs in the canoe, the canoe-carried cooler having rails formed along the side walls thereof which engage the rim as the canoe-carried cooler is pulled toward an end of the canoe.

6 Claims, 10 Drawing Figures

REMOVABLE CANOE-CARRIED COOLER

My invention relates to canoeing.

The principal object of my invention is to provide a removable canoe-carried cooler for use in holding food and beverages during canoe trips.

The foregoing object of my invention and the advantages thereof will become apparent during the course of the following description, taken in conjunction with the accompanying drawings, in which.

Figure 1:
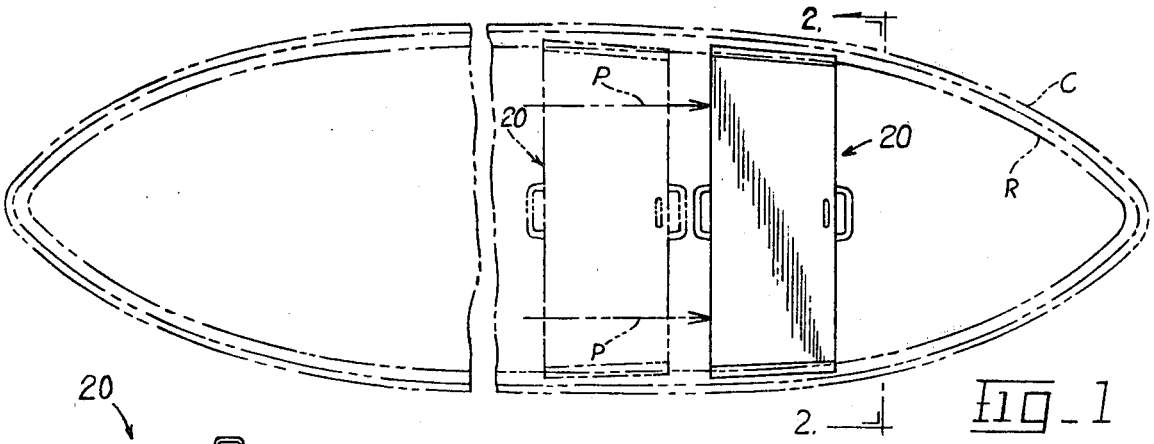
FIGS. 1 and 2 are top plan and front elevational views on a reduced scale of a canoe-carried cooler embodying my invention.
Figure 2:
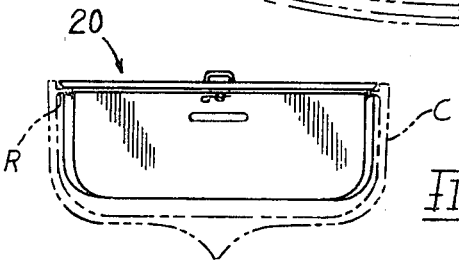
Figure 4:
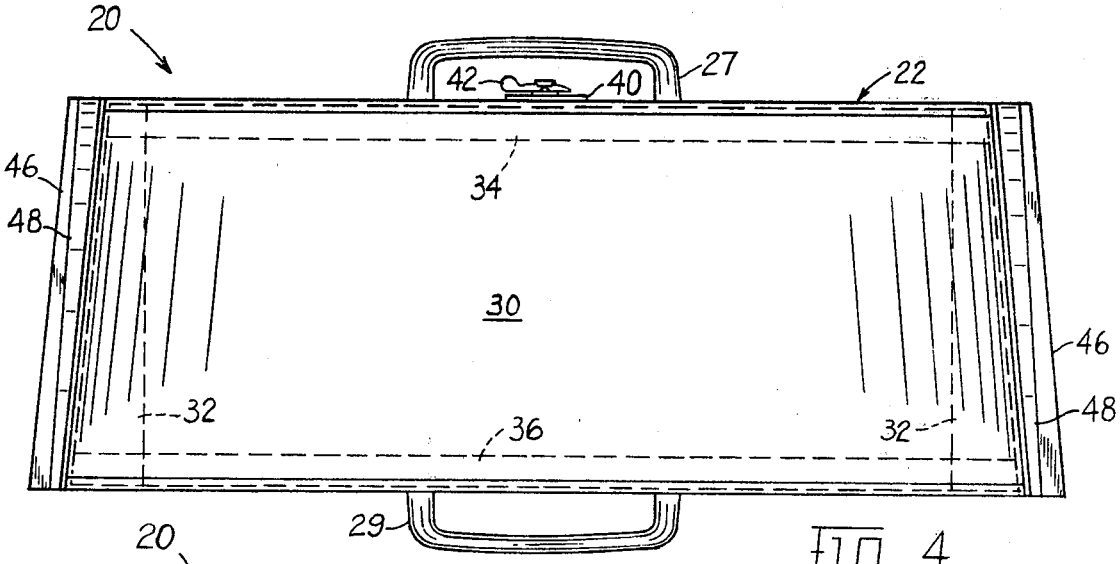
FIGS. 3–8 are, respectively, top plan, bottom plan, front, rear, right side and left side elevational views of said embodiment.
Figure 3:
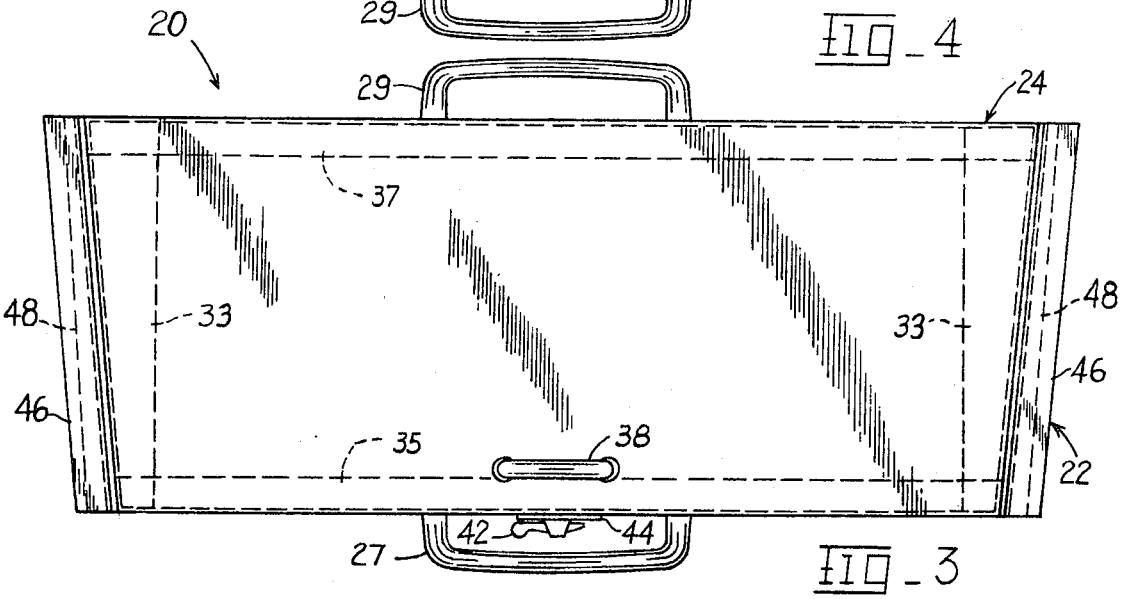
Figure 6:
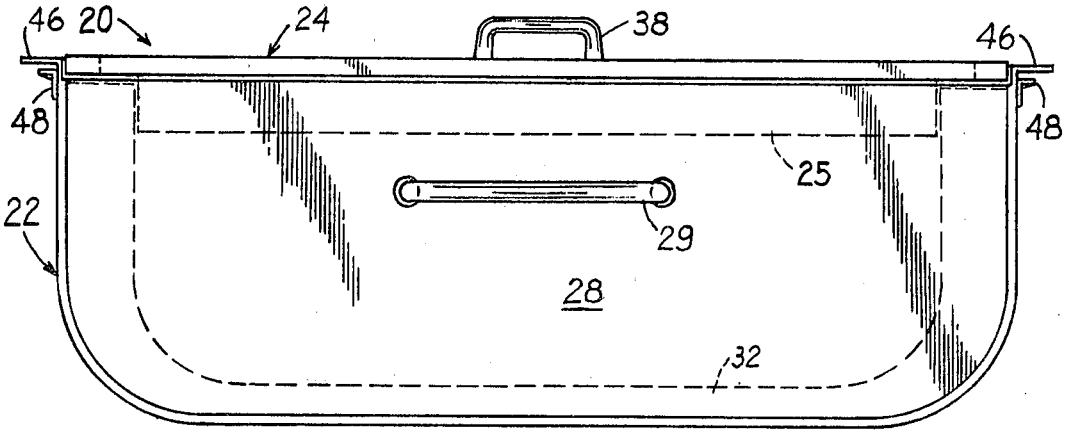
Figure 5:
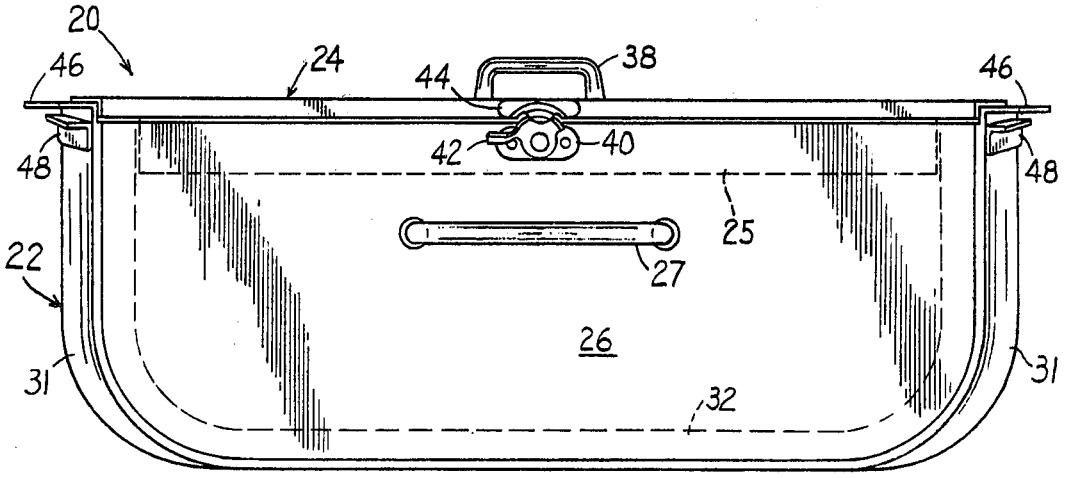
Figures 7, 8:
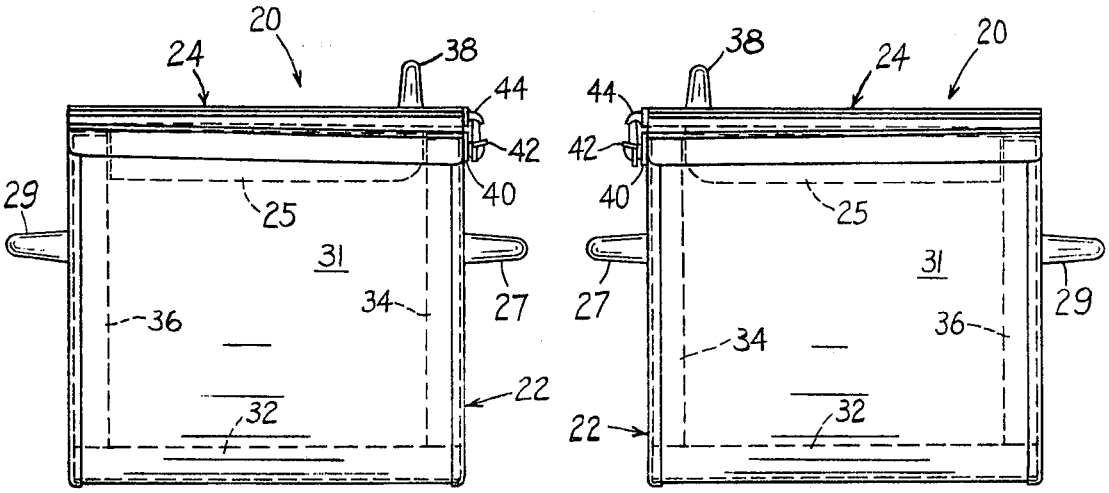
Figure 10:
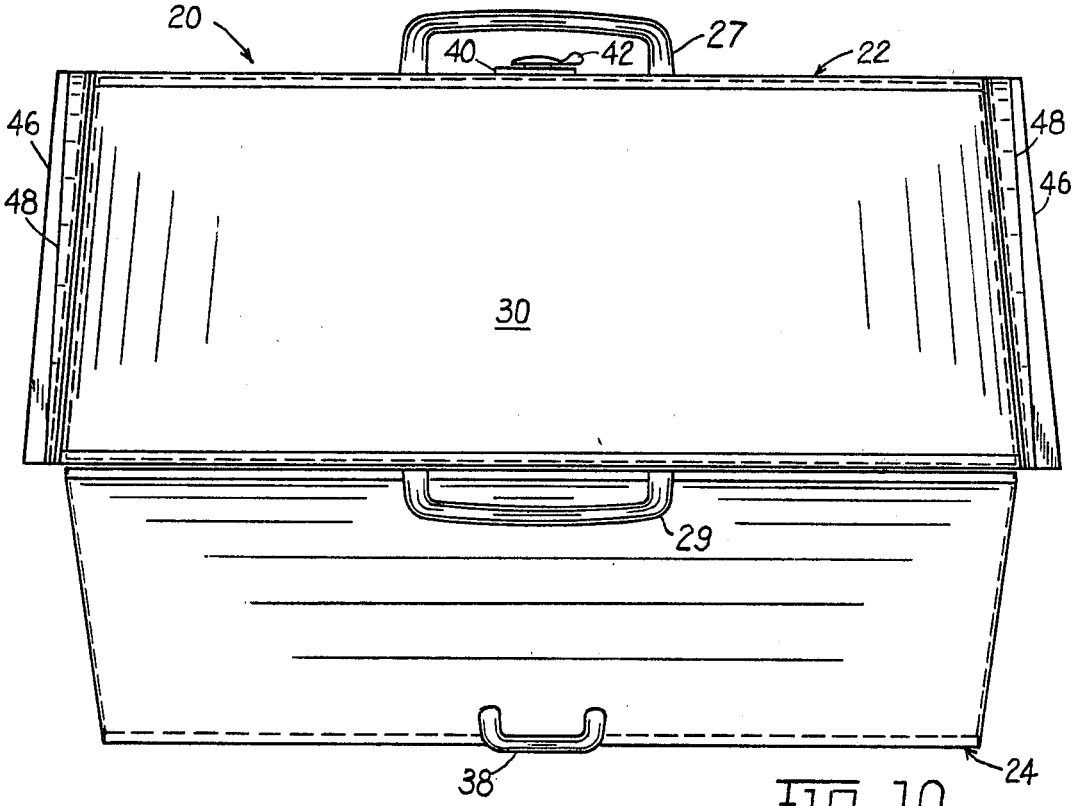
FIGS. 9 and 10 are, respectively, top plan and bottom plan views of said embodiment shown with its lid open.
Figure 9:
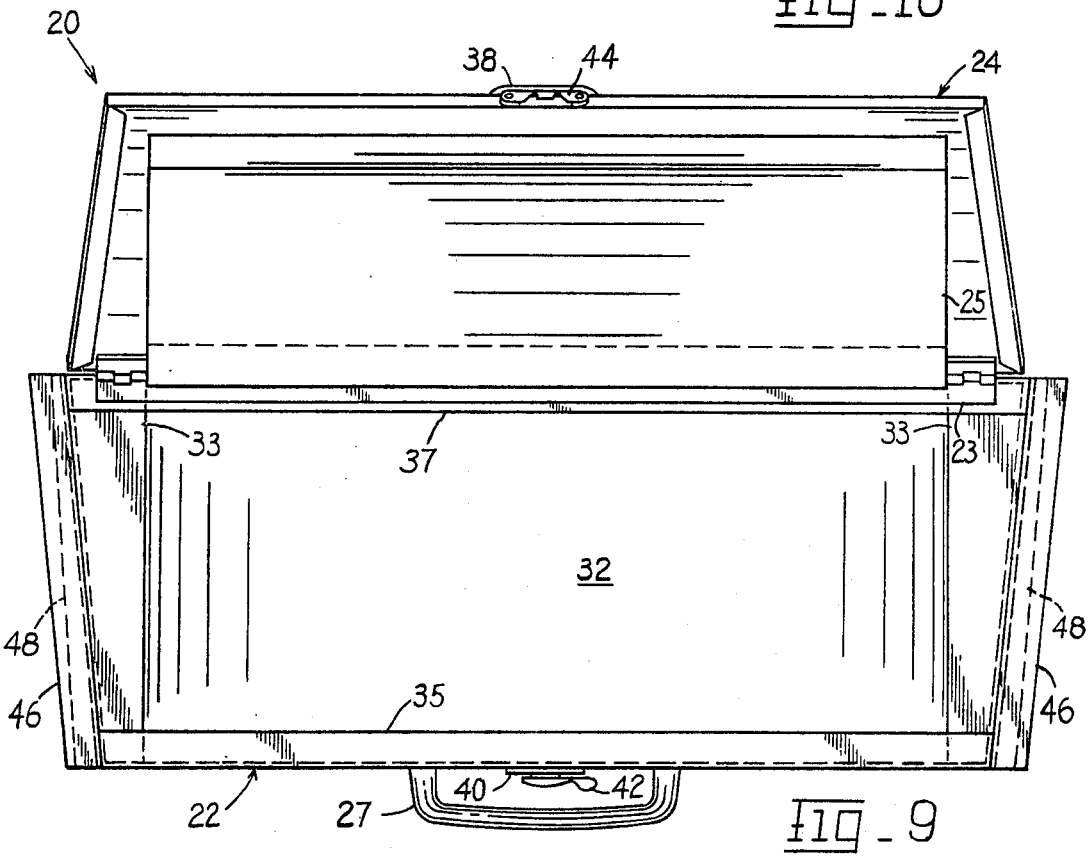

Referring to the drawings in greater detail, 20 generally designates said embodiment which comprises an insulated container portion 22 and an insulated lid 24 hinged together, as at 23. Said container portion 22 is made of sheet metal exterior walls, viz, front, rear, bottom and side walls 26, 28, 30 and 31, respectively, and top walls 33, 35 and 37 and interior insulation 32, 34 and 36. Said lid 24 is made of interiorly insulated sheet metal exterior walls and exterior insulation 25. A lock 40, 42, 44 is provided for the lid 24 at the front end of the canoe-carried cooler 20. Handles 27 and 29 are provided for the front and rear walls 26 and 28, respectively, and a handle 38 is provided for the lid 24. The side walls 31 of the canoe-carried cooler 20 are tapered from front to back so as to be wider at the back than at the front and are provided with top and bottom rails 46, 48, respectively. The canoe-carried cooler 20 is designed to be inserted into a canoe C having an interior perimeter top rim R so that the top rails 46 thereof rest upon said rim R (it is mostly aluminum canoes that have such rim R). The canoe-carried cooler C is then pulled toward one end of the canoe C as shown by the pair of arrows P in FIG. 1 so that the tapered walls 31 thereof wedge against said rim R. The wedging of the canoe-carried cooler 20 is greater because the width of the canoe C tapers at each end and likewise the distance or width between opposing sections of the rim R. Each bottom rail 48 tapers upwardly in respect to the top rail 46 as it extends rearwardly of the canoe-carried cooler 20 from front to back thereof so that the rim R becomes wedged between the rails 46 and 48 as the canoe-carried cooler 20 is pulled toward an end of the canoe C as described. The bottom rails 48 are narrower in width than the top rails 46 and are also narrower in width than the rim R at the place of insertion into the canoe C so that they clear the rim R when the canoe-carried cooler 20 is first inserted in the canoe C and suspended by the top rails 46 resting on the rim R. As the canoe-carried cooler 20 is pulled toward an end of the canoe C as shown by the pair of arrows P in FIG. 1, the bottom rails 48 move beneath the rim R and ensures that the canoe-carried cooler 20 will remain held in the canoe C even in the event of capsize thereof; during capsize the canoe-carried cooler 20 will at least be suspended on the rails 48 (if not otherwise wedged in the canoe C by the walls 31 and by the rails 46, 48) so that it cannot fall out of the inverted canoe C.

It will thus be seen that there has been provided by my invention a canoe-carried cooler in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. A removable canoe-carried cooler for a canoe having an interior perimeter top rim, said canoe-carried cooler having an insulated container portion, an insulated hinged lid therefor, and a lock for the lid, said canoe-carried cooler constructed to be fitted into a canoe and to be removed therefrom at will, the construction of said canoe-carried cooler being such that when it is inserted in said canoe and pulled toward an end thereof it wedges and locks itself in place therein, said canoe-carried cooler having tapered side walls which are wider at one end than at the other so that as the canoe-carried cooler is pulled toward an end of the canoe widthwise wedging thereof occurs in the canoe, the canoe-carried cooler having rail means formed along the side walls thereof which engage said rim as the canoe-carried cooler is pulled toward an end of said canoe.

2. A removeable canoe-carried cooler as claimed in claim 1, said rail means comprising a top and bottom rail on each side of said canoe-carried cooler, said top rails being widthwise wider than said rim at the place of insertion of the canoe-carried cooler in the canoe so that the canoe-carried cooler is suspended on said rim and slides therealong as it is wedged in the canoe, said bottom rails being widthwise narrower than said rim at the place of insertion of the canoe-carried cooler in the canoe so that said bottom rails move under said rim and serve to suspend the cooler in the event of capsize of the canoe.

3. A removable canoe-carried cooler as claimed in claim 2, said top and bottom rails being tapered vertically in respect to each other on each side of said canoe-carried cooler so that the vertical distance between them decreases toward one end of said cooler, whereby said rail means is capable of wedging with the vertical thickness of said rim during sliding of said cooler toward one end of the canoe.

4. A method for removably carring a cooler in a canoe having an interior perimeter top rim, said method comprising providing a canoe-carried cooler consisting of an insulated container portion, an insulated hinged lid therefor, and a lock for the lid, constructing said canoe-carried cooler so that it can be fitted into a canoe and be removed therefrom at will, the construction of said canoe-carried cooler being such that when it is inserted in said canoe and pulled toward an end thereof it wedges and locks itself in place therein, providing said canoe-carried cooler with tapered side walls which are wider at one end than at the other so that as the canoe-carried cooler is pulled toward an end of said canoe widthwise wedging thereof occurs in said canoe, providing said canoe-carried cooler with rail means formed along the side walls thereof which engage said rim as the canoe-carried cooler is pulled toward an end of said canoe.

5. The method as claimed in claim 4 further comprising providing said rail means with a top and bottom rail on each side of said canoe-carried cooler, making said top rails widthwise wider than said rim at the place of insertion of the canoe-carried cooler in the canoe so that the canoe-carried cooler is suspended on said rim and slides therealong as it is wedged in the canoe, making said bottom rails widthwise narrower than said rim at the place of insertion of the canoe-carried cooler in the canoe so that said bottom rails move under said rim and serve to suspend the cooler in the event of capsize of the canoe.

6. The method as claimed in claim 5, further comprising tapering said top and bottom rails vertically in respect to each other on each side of said canoe-carried cooler so that the vertical distance between them decreases toward one end of said cooler, whereby said rail means is capable of wedging with the vertical thickness of said rim during sliding of said cooler toward one end of the canoe.

* * * * *